United States Patent [19]

Grabel et al.

[11] Patent Number: 4,971,324

[45] Date of Patent: Nov. 20, 1990

[54] VARIABLE POSITION FLIPPER MECHANISM FOR PINBALL GAMES

[75] Inventors: Irwin J. Grabel, Elmwood Park; James A. Patla, Sr., Rolling Meadows, both of Ill.

[73] Assignee: Midway Manufacturing Company, Chicago, Ill.

[21] Appl. No.: 452,289

[22] Filed: Dec. 18, 1989

[51] Int. Cl.[5] ..... A63D 3/02

[52] U.S. Cl. ..... 273/129 V; 273/119 R; 273/119 A; 273/129 R

[58] Field of Search ..... 273/119 R, 119 A, 129 R, 273/129 V

[56] References Cited

U.S. PATENT DOCUMENTS 2,910,296 10/1959 Irwin ..... 273/119 R 4,109,916 8/1978 Breslow et al. ..... 273/129 V

*Primary Examiner*—Edward M. Coven

*Assistant Examiner*—Raleigh W. Chiu

*Attorney, Agent, or Firm*—Rockey and Rifkin

[57] ABSTRACT

A variable position flipper mechanism is disclosed for use with pinball or rolling ball games. The flippers, actuated by solenoid mechanisms, are spaced a selectable distance apart thereby to permit adjustment in the skill level of the game. Spacing of the flipper mechanisms is accomplished by rotating a cam plate which is ratcheted into various positions by a pair of solenoid operators and appropriate linkages. Rotation of the cam plate in a first direction spaces the flippers at their maximum distance, while rotation in the opposite direction moves the flippers to successively closer positions. Optical detection means can be associated with the cam plate to provide position information to a controller associated with the pinall machine.

18 Claims, 7 Drawing Sheets

VARIABLE POSITION FLIPPER MECHANISM FOR PINBALL GAMES

BACKGROUND OF THE INVENTION

The present invention relates to pinball games and the like, wherein a rolling ball travels on an inclined surface and players alter the motion of the ball by operation of flippers or similar impact devices. In a traditional pinball game, the flippers are spaced apart by an amount sufficient to permit the rolling ball to pass therebetween, usually to an outhole which ends a player's turn. The spacing of the flippers is an important matter for if the flippers are spaced too far apart, the game will be difficult for beginners and may therefore discourage play. However, if the flippers are too close together, the game will not challenge advanced players, and also results in long play times and reduced operator revenue.

Prior efforts to deal with this issue have been only somewhat satisfactory. In some games, a post, which can be retracted to a position flush with the playfield or extended above the playfield, has been employed. This post is positioned between the flippers and thus, when extended, it prevents a ball from passing between the flippers to the outhole. Such a post can be controlled by the game processor as a reward for making certain targets or achieving certain score totals. Similar results can be achieved with gates. Although solving some of the problem concerning the spacing of the flippers, the use of a post, gate or similar obstruction does not provide as wide a degree of designer choice as could be achieved by having the ability to accurately control and vary the spacing of the flippers. It is desired to vary that spacing according to certain game rules; to reward players for making certain targets or point totals; to render the game acceptable to beginners with progressively more difficult positions being employed as player skill increases.

It is accordingly an object of the present invention to provide an improved flipper mechanism which can be variably positioned so that the distance between the flippers through which a ball may pass to an outhole can be varied as desired.

It is a further object of the present invention to provide a variable position flipper mechanism which can be controlled by the game processor to alter the relative position of the flippers as a function of game rules, score levels or other design criteria.

Another object of the invention is to provide an increased level of player interest by providing a variable position flipper mechanism which can increase game difficulty as player skill increases.

These and other objects of the invention will be apparent from the remaining portion of the specification.

DETAILED DESCRIPTION OF THE INVENTION

Figure 1:
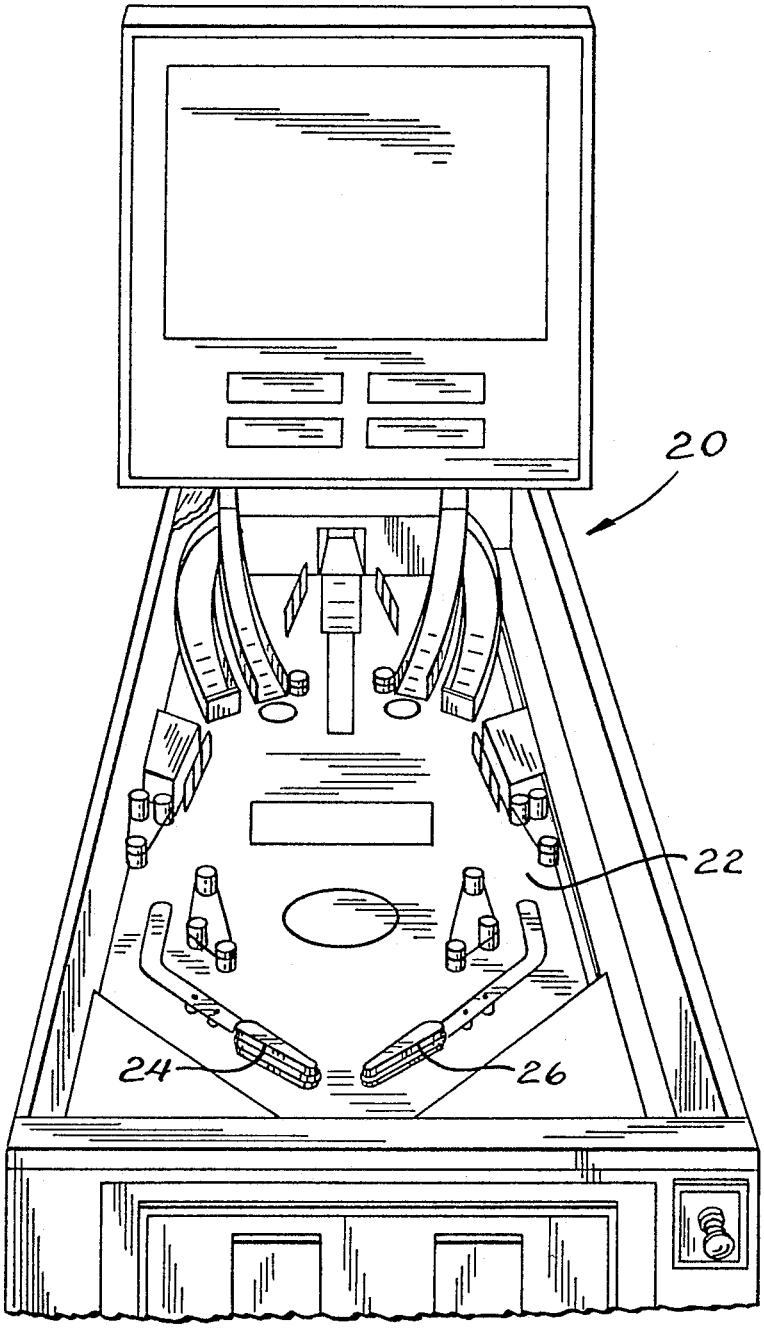
FIG. 1 illustrates a perspective view of a typical pinball playfield suitable for use with the present invention.

Referring to FIG. 1, there is shown a pinball game 20 having the usual playfield 22 onto which a pinball is projected. Also shown are a number of ramps, targets and other features typical of modern day pinball machines. At the lower end of the playfield 22 are a pair of flippers 24 and 26 which are player controlled in the usual case by switch buttons located on the side of the pinball machine. A player use these switches to operate the flippers to return the pinball to the upper portion of the playfield, thereby to prevent it from going into the outhole or drain which is located at the lower end of the playfield. As shown in FIG. 1, there is a space between the flippers 24 and 26 through which the pinball can pass regardless of whether the flippers are operated by the player. The spacing between the flippers is an important design consideration. If this space is too great, the game will be difficult for beginners, thereby discouraging play. On the other hand, if the space between the flippers is too small, skilled players will soon tire of the game as it will present little challenge and revenue will decrease because games will last for an excessive period of time.

According to the present invention, a variable position mechanism is provided whereby the space between the flippers can be adjusted as the play of the game progresses. The adjustment can be controlled by the microprocessor control system associated with modern day pinball games.

Figure 2:
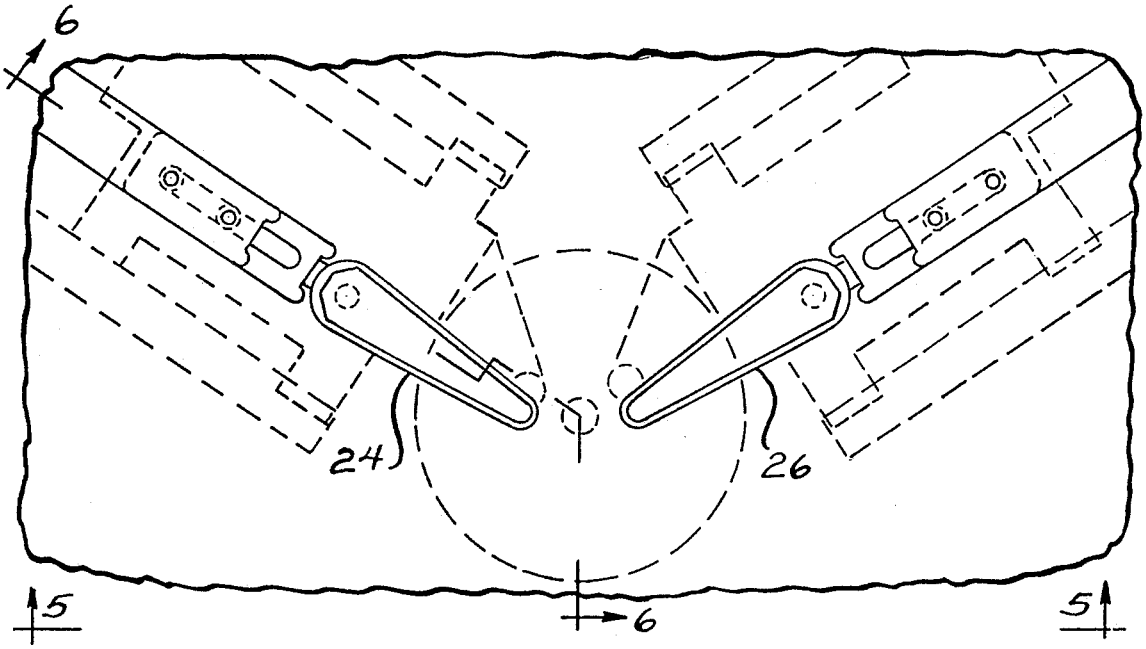
FIGS. 2 and 3 are plan views of variable position flippers mounted on a playfield in accordance with the present invention.
Figure 3:
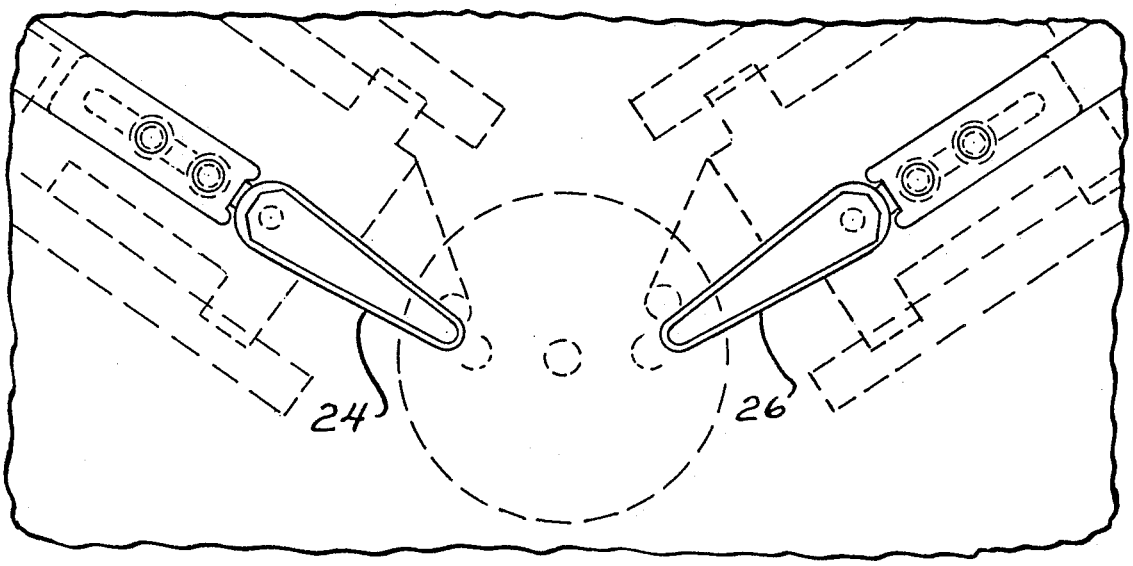

Referring to FIGS. 2 and 3, there is illustrated flippers 24 and 26 in their two extreme positions. Thus, in FIG. 2, the flippers are as close together as permitted so that it is almost, but not quite, impossible for a ball to travel between the flippers to the outhole. In FIG. 3, the flippers are separated by a substantially greater distance so that it is easier for a ball to pass therebetween.

It is important to note, however, that in both cases (and in all intermediate positions between the two extremes) the angle of the flippers relative to the playfield does not change. This is important because the playfield design is based, in part, upon the angle at which the flippers are set. Thus, the various targets and ramps are positioned by the game designer so that the shots can be made by the player employing flippers at a known angle. If the angle of the flippers were to change as they moved toward and away from each other, this could adversely affect the player's ability to accurately hit the various ramps and targets. This, of course, would be counterproductive to the objective of improving the enjoyment of the game and maintaining competitiveness over a range of skill levels. According to the present invention, regardless of the distance between the flippers, the correct angle of the flippers relative to the playfield is maintained.

Figure 4:
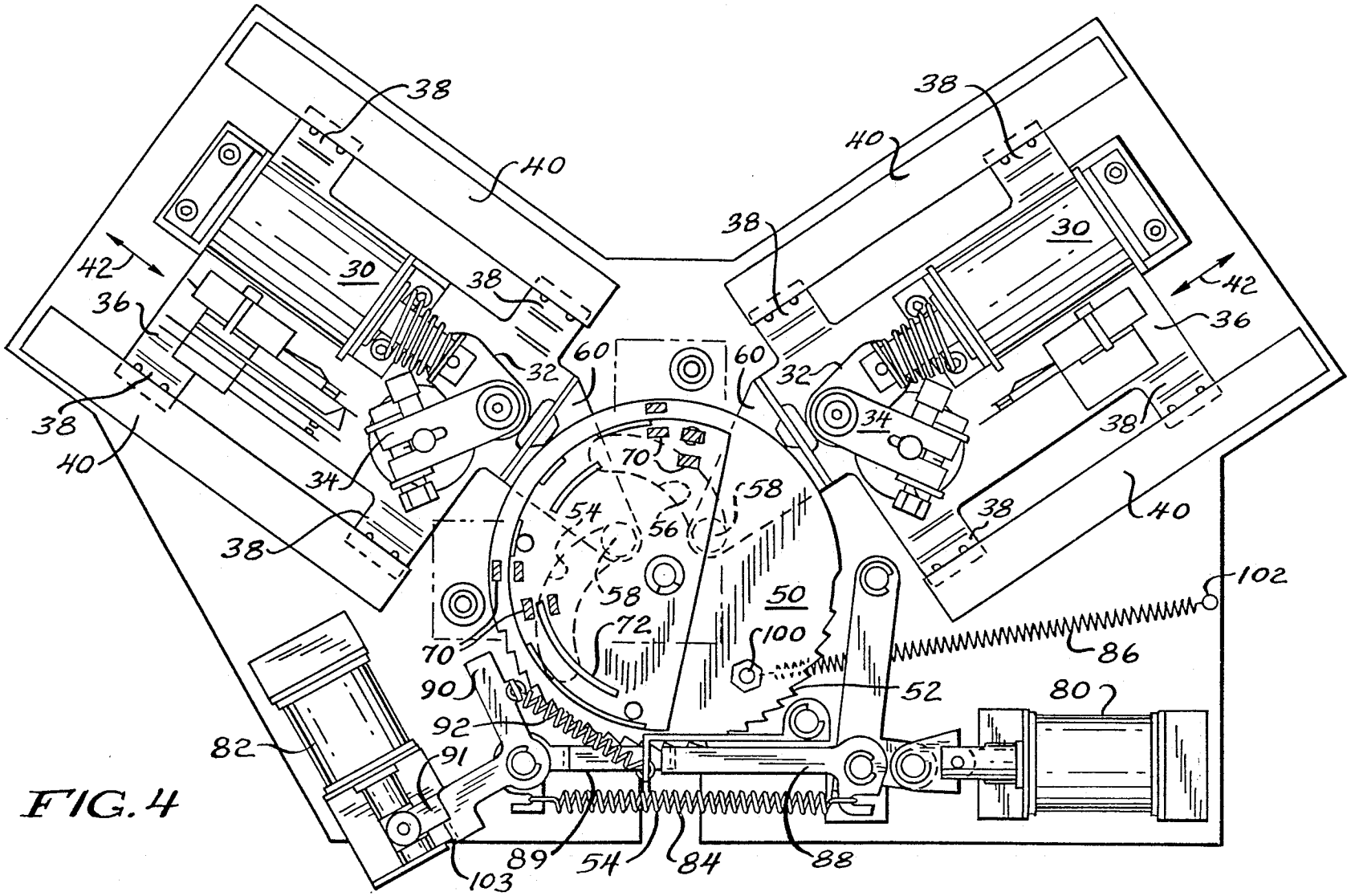
FIG. 4 is a bottom plan view of the mechanism for controlling the position of the flippers according to the present invention.
Figure 5:
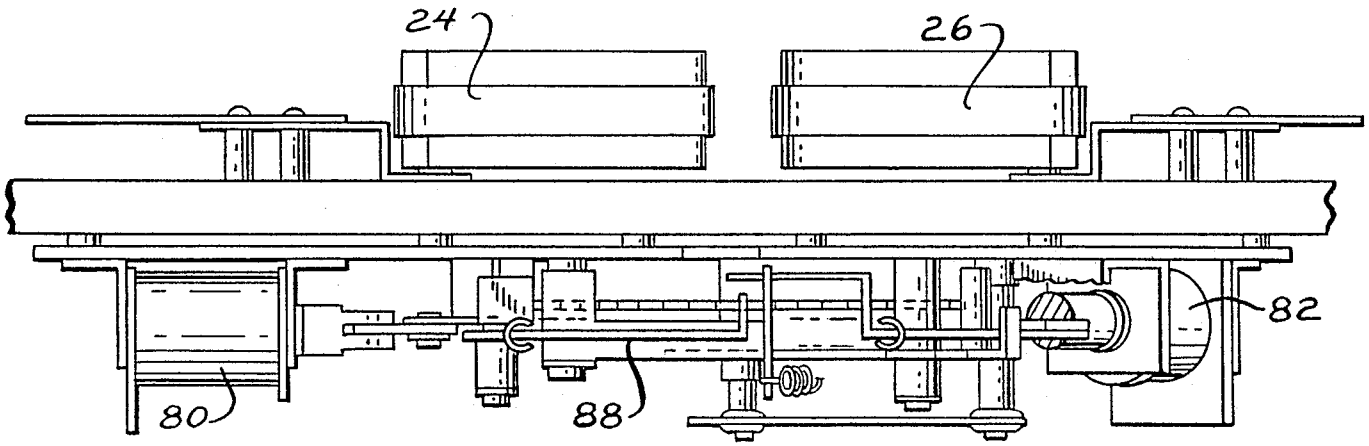
FIG. 5 is a side elevational view along the lines 5—5 of FIG. 2.

Referring now to FIG. 4, the variable positioning mechanism, according to the present invention, is illustrated. The flippers are player controlled. Each flipper is provided with a solenoid 30 which causes the flipper to strike the pinball when operated by the player. The manner in which the flipper mechanism operates is well-known in this art and will not be described in detail. In brief, the solenoids 30 are connected by a linkage 32 to a shaft 34 on which the flippers 24 and 26 are mounted. Operation of the solenoids causes the linkage to rotate the shaft, thereby to cause the flippers to rotate and strike a pinball on the playfield.

In the usual case, the flipper mechanism just described is mounted directly to the underside of the playfield, thereby fixing the distance between the flippers. In the present invention, each flipper mechanism is mounted instead on a plate 36 having extensions tabs 38 which are received in channels indicated as 40 in the drawings. The plates 36 and the flipper mechanisms mounted thereon are thus positioned for linear movement within the channel 40 as indicated by the arrow 42. The shaft 34 to which the flipper is mounted, extends upwardly to the playfield through an elongated slot best shown in FIG. 6.

Movement of the plates 36 on which the flipper mechanisms are mounted is controlled by an indexing mechanism now to be described. A cam plate 50 is rotatably mounted to the underside of the playfield and includes a number of ratchet teeth 52 along a portion of the periphery thereof. Arcuate slots 54 and 56 are cut into the central portion of the cam plate 50. Each slot is intended to receive a follower pin 58 which secures a tab extension 60 formed on the plate 36. As will be understood, and as explained in detail hereafter, rotation of the cam plate 50 causes movement of the plates 36 as indicated by the arrow 42. As the cam plate rotates from the position shown in FIG. 4 (the closed position), to the position shown in FIG. 10 (the open position), the slots 54 and 56 cause the plates 36 to move outwardly from the cam plate 50, thereby moving the flippers away from each other and increasing the distance therebetween.

Figure 6:
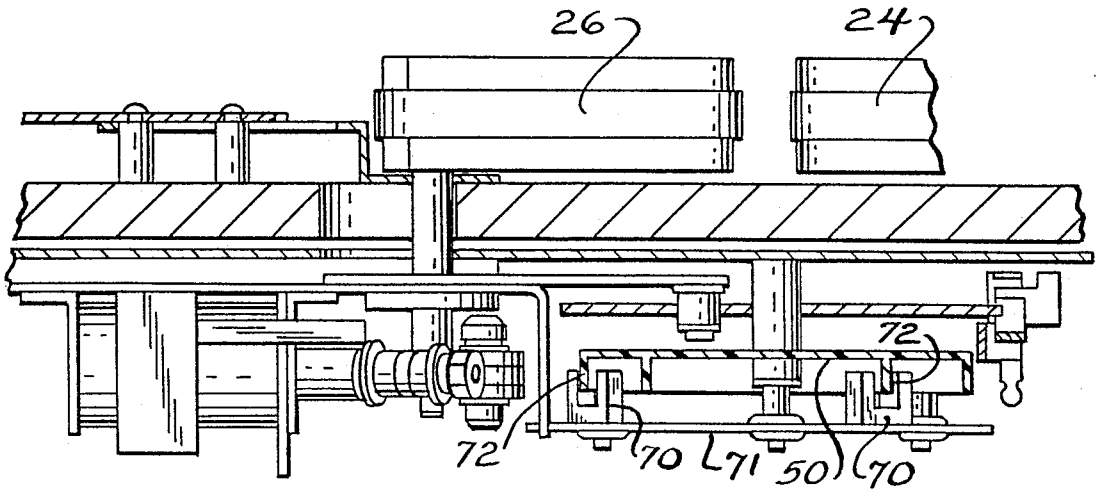
FIG. 6 is a side sectional view along the lines 6—6 of FIG. 2.

So that the same microprocessor can know the precise position of the cam plate, it is desirable to provide a signaling means. One such acceptable mechanism for signaling the processor includes the use of optical detectors 70 positioned on a circuit board 71 mounting beneath the indexing mechanism (FIG. 6). These horseshoe-shaped solid state devices are dimensioned to receive an interrupting element 72, carried by the cam plate 50. As shown in FIG. 6, when the interrupting element passes between the upwardly extending arms of the detector 70, a digital signal is generated which can be detected and interpreted by the microprocessor, thereby to determine the position of the cam plate and, in turn, the spacing of the flippers.

With this information, in a manner well-known to those skilled in the art, the indexing mechanism of the present invention can be controlled to permit precise positioning of the flipper elements as desired. For example, minimum spacing can be employed, thereby making the game easier, at the beginning. As the game progresses, the flippers can be moved further apart as a function of a number of variables, such as time, score, number of targets hit, etc. Alternatively, movement of the flippers can be controlled as a bonus feature so that the flippers move together whenever a player makes a predetermined sequence of targets or achieves a predetermined score. Thereafter, the flippers can be separated to again render the game more difficult. The possibilities are virtually limitless and will be set by the game designer as deemed appropriate for a particular game theme.

The point is that the electromechanical indexing mechanism of this invention permits variable positioning of the flippers. This permits a game designer to vary the skill level as a function of any desired game parameter. The signals from the optical detector portion of the system permit the processor to determine the present position of the flippers and ensure that appropriate modifications have taken place when it is desired to change the flipper positions. In the fully closed position of FIG. 4, only one of the detectors 70 generates a signal. In progressive positions shown in FIGS. 7–10, different combinations of the detectors will generate signals, each consisting a unique digital code relating to the position of the flippers.

In order to move the flippers apart, the cam plate is indexed by a mechanism which includes an advance solenoid 80, a reset solenoid 82 and associated linkages, and springs.

The advance solenoid 80 is associated with an index follower 88, the distal end of which is adapted to engage the teeth 52 on the cam plate 50. An advance spring 84 provides the return stroke after operation of the solenoid 80.

A reset solenoid 82 includes a reset follower 90 and a release arm 91 linked to the solenoid. The distal end of the follower 90 is adapted to selectively engage the teeth 52 of the cam plate 50 when permitted by the release arm 91. A spring 92 biases the reset follower into engagement with the teeth.

As indicated, FIG. 4 shows the mechanism in the fully closed position in which the flippers are as close together as permitted by the dimensions of the slots 54 and 56 in the cam plate 50. FIGS. 7–10 illustrate the mechanism in other positions and are useful in explaining the manner in which the indexing device operates.

Figure 7:
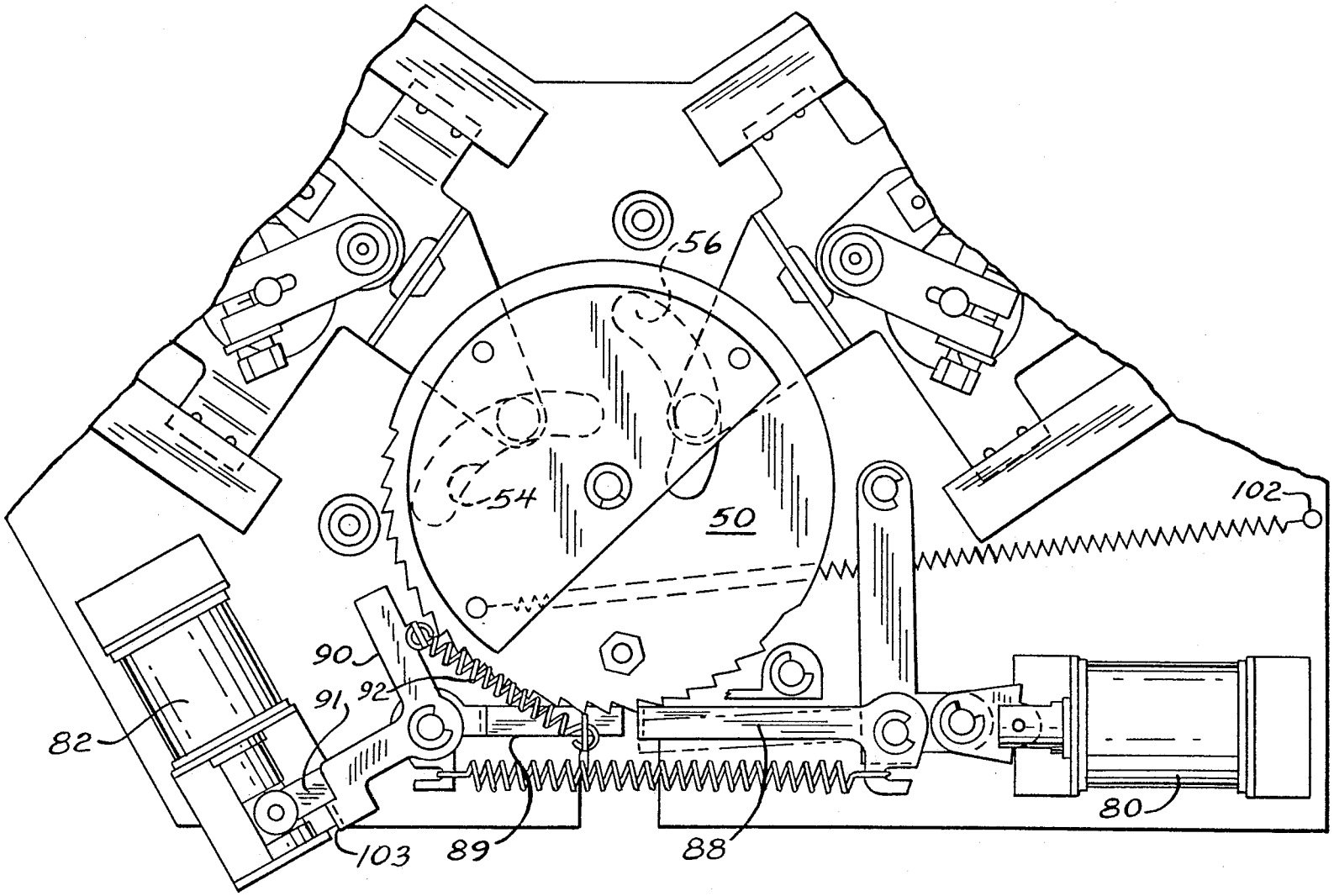
FIGS. 7 through 10 are bottom plan views illustrating the indexing operation of the mechanism according to the present invention.

In particular, FIG. 7 shows the solenoid 80 in its retracted position, such that the follower 88 is drawn to the right, in preparation for an indexing operation, whereby the cam plate 50 will be rotated clockwise the dimension of one tooth. When the solenoid 80 retracts its plunger to move the follower 88 to the position shown in FIG. 7, a stop arm 89 engages the cam plate to prevent it from turning in a counter-clockwise direction.

After the advance solenoid 80 retracts the follower 88, spring 84 extends it (FIG. 8) which results in one-tooth rotation of the cam plate 50. Restated, the reciprocal movement of the index follower causes it to engage the next tooth on the periphery of the cam plate and then force that tooth forward by the amount of the stroke of the solenoid. The stop arm 89 is automatically released during the clockwise movement of the cam plate. As shown in FIG. 4, the reset follower 90 normally is disengaged from the cam plate. In this manner, the index follower can move the cam plate clockwise, until the desired position of the flippers is achieved.

Figure 8:
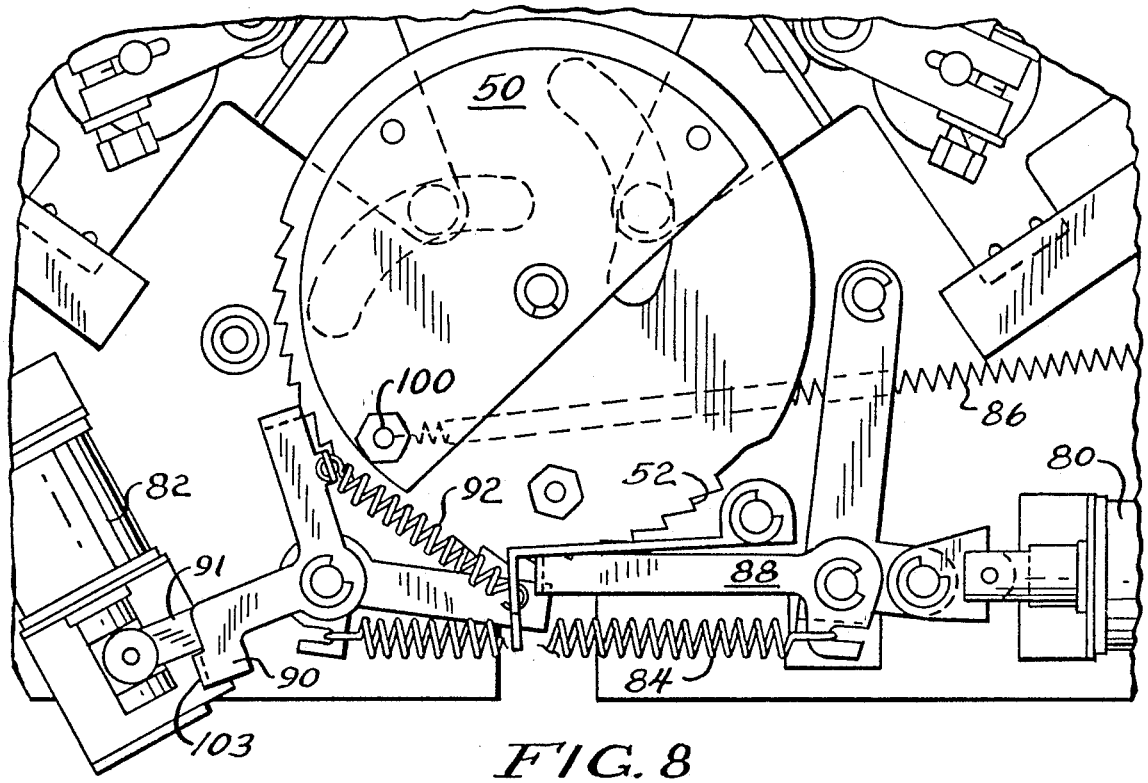
Figure 9:
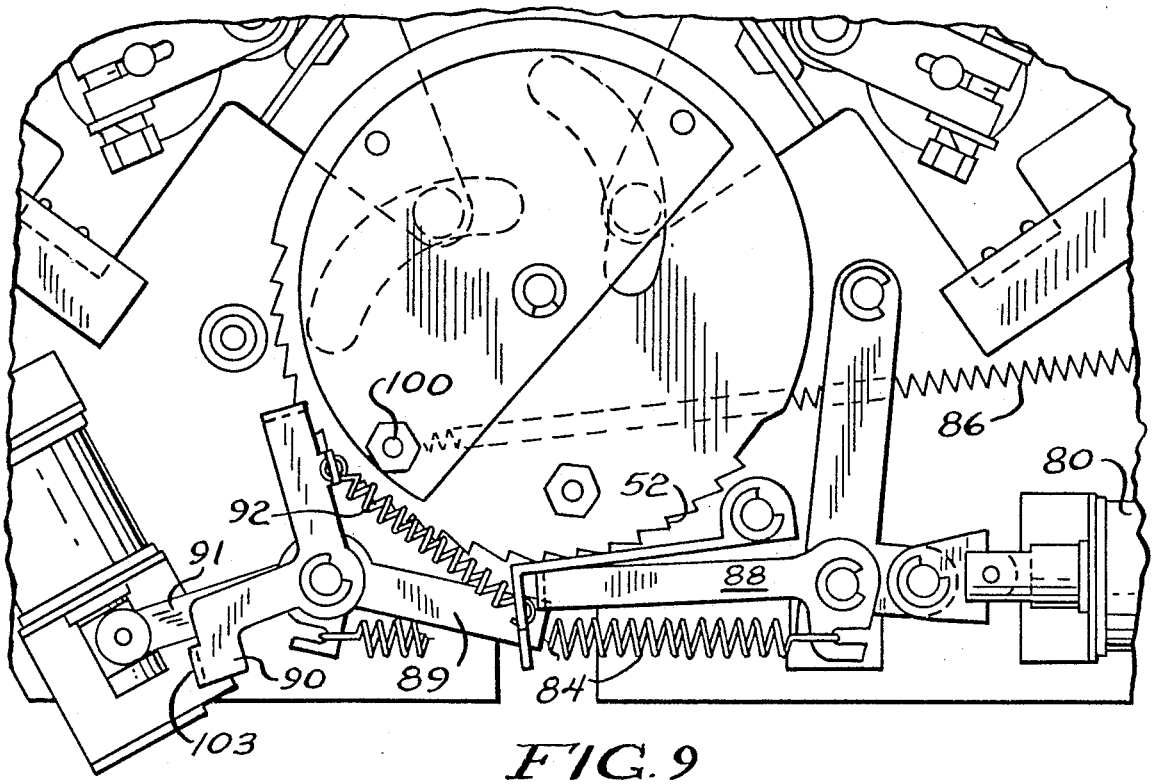
Figure 10:
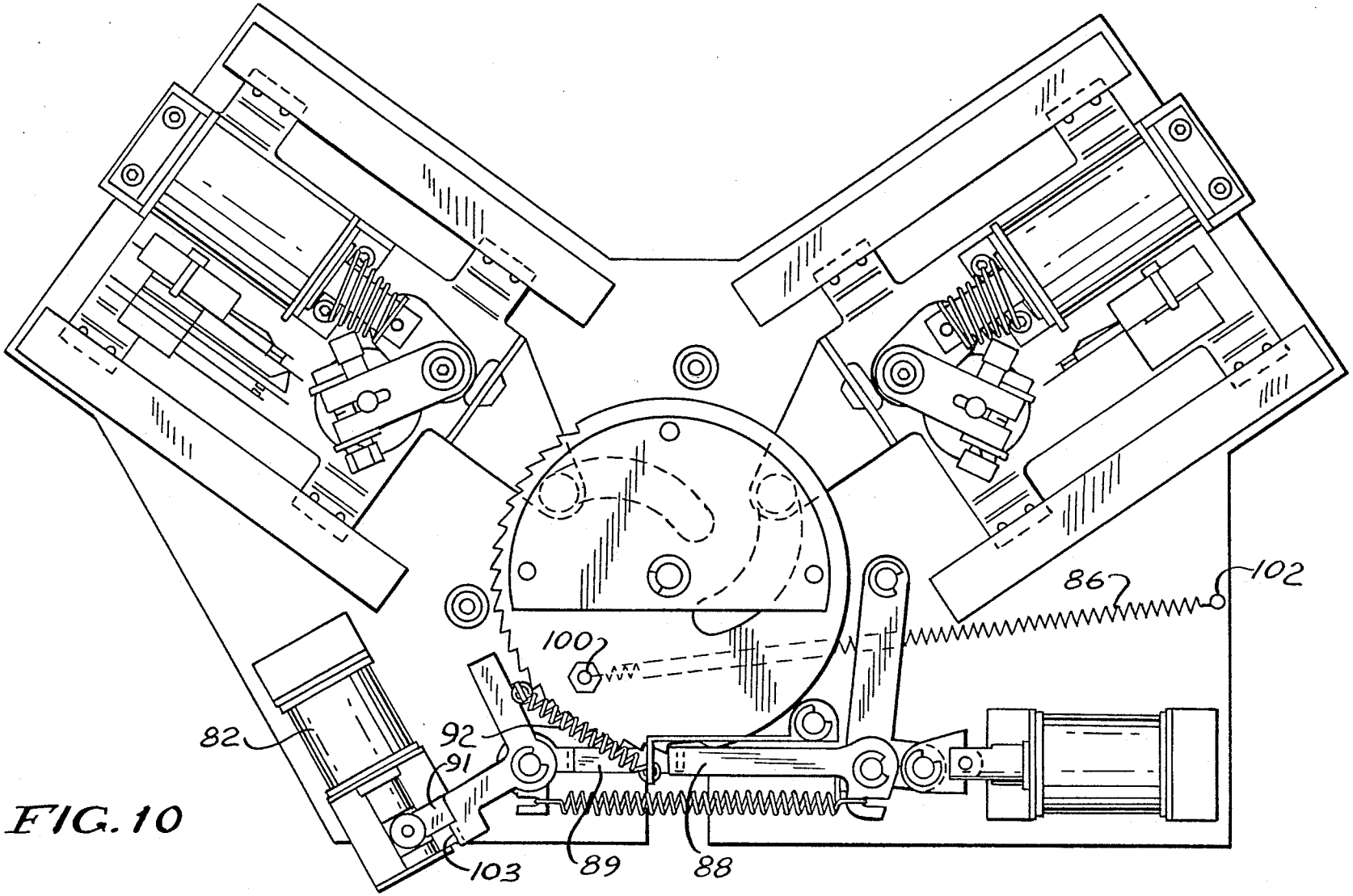

When it is desired to move the cam from the fully open position shown in FIG. 10 to an intermediate position, or to the fully closed position of FIG. 4, the reset solenoid 82 is operated. This retracts its plunger, engaging the reset follower 90 with the cam plate teeth (FIGS. 8 and 9). To free the cam plate for counter-clockwise return rotation, it is necessary to disengage the index follower 88 and the stop arm 89 from the cam plate. The stop arm release 91, linked to the solenoid 82, accomplishes this function. Thus, as shown in FIG. 8, when the reset solenoid 82 retracts its piston, the release arm 91 engages stop arm 89 to move the latter away from the cam plate 50. This also disengages the index follower 88, freeing the cam plate to rotate.

The return spring 86, attached to the cam plate at 100 and to a fixed location on the underside of the playfield 102, then rotates the cam plate in the counter-clockwise direction. Tooth-at-a-time return movement is accomplished due to the reset follower engaging the cam plate. This is due to the action of the piston of solenoid 82 which moves the release arm away from the stop 103 carried on the follower 90. Spring 92 brings the follower 90 into engagement with the next tooth on the cam plate. As shown in FIGS. 8 and 9, this results in tooth-at-a-time return movement so that the game processor can accurately position the flippers.

After each actuation of solenoid 82, the spring 84 returns the release arm to its original position (FIG. 4). The follower 88 and stop arm 89 reengage the plate 50 and reset follower 90 is disengaged completing the cycle.

As will be understood by those skilled in the art, the indexinq mechanism operates by utilizing the advance solenoid to step or index the cam plate 50 clockwise from the position shown in FIG. 4 to any intermediate position, as represented in FIGS. 7, 8 or 9, or to the fully open position shown in FIG. 10. The return movement is accomplished by freeing the cam plate from the index follower and stop arm so that the return spring 86 can rotate the cam plate in the counter-clockwise direction. This return movement is also indexed a step at a time by the action of the reset follower which alternately engages and disengage the teeth of the cam plate. In this manner, the processor can accurately position the flippers at any desired location between the extremes of FIGS. 4 and 10 in an increment of the width of one cam tooth 52.

It will be understood that the only control signals required to operate the mechanism are the signals supplied to the solenoids 80 and 82. Solenoids, of course, are commonly used in pinball games and the appropriate circuitry for driving them from a microprocessor control system are well-known in this art. It will also be understood that the positioning means of the present invention can be used with playfield mechanisms other than flippers. For example, it can be used to variably position targets and ramps. Such use is limited only by the creativity of the game layout designer. The mechanism is simply mounted to the plate 36 in a manner similar to the mounting of the flipper mechanism.

While the principles of this invention have been described in connection with a specific embodiment thereof, it is to be understood that various changes in form and detail can be made without departing from the true spirit and scope of the claimed invention.

What is claimed is:

1. An apparatus for variably positioning at least two flipper mechanisms on a playfield of a rolling ball game comprising:

(a) at least two flipper mechanisms, each including a flipper mounted for rotational motion about an axis, for changing the course of said rolling ball during play;

(b) means for rotating each flipper about the associated axis;

(c) means for slidably mounting each flipper mechanism to said playfield for translational movement between a first position wherein said flippers are relatively close together and a second position wherein said flippers are relatively far apart, and;

(d) means for sliding said flipper mechanisms in such mounting means to a plurality of selected intermediate positions between said first and second positions.

2. The apparatus of claim 1, wherein said means for slidably mounting a flipper mechanism includes:

(a) a plate on which the flipper mechanism is mounted, and;

(b) channel means secured to the playfield, said plate including extension means for slidably securing said plate in said channel means for movement therein.

3. The apparatus of claim 1, wherein said sliding means includes:

(a) rotatable cam means;

(b) means for securing said flipper mechanisms to said cam means for movement therewith, and;

(c) means for bidirectionally rotating said cam means whereby rotation of said cam means in one direction slides said flipper mechanisms towards one of said positions, while rotation of the cam means in the other direction reverses the movement of the flipper mechanisms to permit variable, selectable positioning of said flipper mechanisms between said positions.

4. The apparatus of claim 3, wherein said rotatable cam means is a cam plate mounted for rotation to said playfield.

5. The apparatus of claim 3, wherein said means for slidably mounting includes an extension tab;

said securing means including:

(a) an arcuate, radially inwardly disposed slot in said cam means, and;

(b) means for coupling said extension tab to said slot for movement therein, whereby rotation of said cam means moves said flipper mechanisms between said extreme positions.

6. The apparatus of claim 5, wherein said means for coupling includes a follower pin movable in said slot and which is secured to said extension tab.

7. The apparatus of claim 3, wherein said means for bidirectionally rotating said cam means includes:

(a) advance means for rotating said cam means in a first direction;

(b) reset means for rotating said cam means in the opposite direction of said first direction, and;

(c) stop means associated with said advance means and said reset means for holding said cam means in position after movement.

8. The apparatus of claim 7, wherein said means for bidirectionally rotating further includes:

(a) means cooperating with said stop means for limiting movement of said cam means to a fixed increment for each operation of said advance means and said reset means.

9. The apparatus of claim 3 further including means carried by said cam means for detecting the position of said flipper mechanisms.

10. The apparatus of claim 1 further including means for detecting the position of said flipper mechanisms.

11. An apparatus for selectably positioning a playfield mechanism on a playfield of a rolling ball game comprising:

(a) a playfield mechanism;

(b) means for slidably mounting said playfield mechanism to said playfield for translational movement between extreme positions, and;

(c) means for moving said playfield mechanism in said mounting means, said mounting means including:

(i) rotatable cam means;

(ii) means for securing said playfield mechanism to said cam means for movement therewith, and;

(iii) means for bidirectionally rotating said cam means whereby rotation of said cam means in one direction slides said playfield mechanism towards one of said extreme positions, while rotation of the cam means in the other direction reverses the movement of the playfield mechanism to permit variable positioning of said mechanism.

12. The apparatus of claim 11, wherein said means for slidably mounting the playfield mechanism includes:

(a) a plate on which the playfield mechanism is mounted, and;

(b) channel means secured to the playfield, said plate including extension means for slidably securing said plate in said channel means for movement therein.

13. The apparatus of claim 11, wherein said rotatable cam means is a cam plate mounted for rotation to said playfield.

14. The apparatus of claim 11, wherein said means for slidably mounting includes an extension tab; said securing means including:

(a) an arcuate radially inwardly disposed slot in said cam means, and;

(b) means for coupling said extension tab to said slot for movement therein, whereby rotation of said cam means moves said playfield mechanism between said extreme positions.

15. The apparatus of claim 11, wherein said means for bidirectionally rotating said cam means includes:

(a) advance means for rotating said cam means in a first direction;

(b) reset means for rotating said cam means in the opposite direction of said first direction, and;

(c) stop means associated with said advance means and said reset means for holding said cam means in position after movement.

16. The apparatus of claim 15, wherein said means for bidirectionally rotating further includes:

(a) means cooperating with said stop means for limiting movement of said cam means to a fixed increment for each operation of said advance means and said reset means.

17. The apparatus of claim 11 further including means carried by said cam means for detecting the position of said playfield mechanism.

18. An apparatus for variably positioning at least one flipper mechanism on a playfield of a rolling ball game comprising:

(a) at least one flipper mechanism, including a flipper mounted for rotational motion about an axis, for changing the course of said rolling ball during play;

(b) means for rotating said flipper about said axis, including;

(c) means for slidably mounting said flipper mechanism to said playfield to permit translational movement between selected positions on said playfield;

(d) means for sliding said flipper mechanism in such mounting means, including;

(i) rotatable cam means;

(ii) means for securing said flipper mechanism to said. cam means for translational movement therewith, and;

(iii) means for bidirectionally rotating said cam means whereby rotation of said cam means permits variable, selectable positioning of said flipper mechanisms said playfield.

* * * * *